US008127460B2

(12) United States Patent
Flude

(10) Patent No.: US 8,127,460 B2
(45) Date of Patent: Mar. 6, 2012

(54) TOOL FOR USE IN MARKING TILES

(76) Inventor: David Flude, Lancashire (GB)

( * ) Notice: Subject to any disclaimer, the term of this patent is extended or adjusted under 35 U.S.C. 154(b) by 0 days.

(21) Appl. No.: 12/668,370

(22) PCT Filed: Jul. 11, 2008

(86) PCT No.: PCT/GB2008/002384

§ 371 (c)(1),
(2), (4) Date: Jun. 15, 2010

(87) PCT Pub. No.: WO2009/007735

PCT Pub. Date: Jan. 15, 2009

(65) Prior Publication Data

US 2010/0252016 A1 Oct. 7, 2010

(30) Foreign Application Priority Data

Jul. 11, 2007 (GB) ..... 0713427.3

(51) Int. Cl.
*B28D 1/22* (2006.01)
*G01B 1/00* (2006.01)

(52) U.S. Cl. ..... 33/527; 33/526

(58) Field of Classification Search ..... 33/526–527
See application file for complete search history.

(56) References Cited

U.S. PATENT DOCUMENTS

| | | | | |
|---|---|---|---|---|
| 2,144,697 | A * | 1/1939 | Zangrando | 33/527 |
| 2,855,690 | A | 10/1958 | Marr | |
| 3,548,505 | A | 12/1970 | Candilo | |
| 4,860,723 | A | 8/1989 | Fortin | |
| 5,188,013 | A * | 2/1993 | Cardinale | 33/527 |
| 5,471,758 | A | 12/1995 | White, Sr. | |
| 6,195,904 | B1 * | 3/2001 | Greer | 33/527 |
| 6,481,112 | B1 | 11/2002 | White | |
| 6,523,272 | B1 | 2/2003 | Morales | |
| 7,140,120 | B1 | 11/2006 | Huttemann | |
| 7,409,773 | B1 * | 8/2008 | Gioia et al. | 33/527 |
| 7,493,704 | B2 * | 2/2009 | Bailey | 33/526 |
| 2010/0252016 | A1 * | 10/2010 | Flude | 33/527 |

FOREIGN PATENT DOCUMENTS

| | | |
|---|---|---|
| FR | 1331156 (A) | 6/1963 |
| GB | 2227564 A | 8/1990 |

OTHER PUBLICATIONS

"International Application Serial No. PCT/GB2008/002384, International Search Report mailed Nov. 24, 2008", 2 pgs.
"Great Britain Application Serial No. GB0713427.3, Search Report dated Nov. 21, 2007", 2 pgs.
"International Application Serial No. PCT/GB2008/002384, Written Opinion mailed Nov. 24, 2008", 7 pgs.

* cited by examiner

*Primary Examiner* — Yaritza Guadalupe-McCall
(74) *Attorney, Agent, or Firm* — Schwegman, Lundberg & Woessner, P.A.

(57) ABSTRACT

A tool suitable for holding a ruling tile for using in making a cutting line on a cutting tile. The tool comprises a tile receiving means and a support means for the tile receiving means. The tile receiving means is adapted to space the ruling tile at a desired distance from a boundary of an area to be tiled. The ruling tile overlies the cutting tile. Optionally a laid tile is provided beneath the cutting tile. A method of marking and cutting a tile using such a tool.

19 Claims, 6 Drawing Sheets

TOOL FOR USE IN MARKING TILES

RELATED APPLICATIONS

This application is a nationalization under 35 U.S.C. 371 of PCT/GB2008/002384, filed Jul. 11, 2008 and published as WO 2009/007735 A1 on Jan. 15, 2009, which claimed priority under U.S.C. 119 to United Kingdom Application No.: 0713427.3, filed on Jul. 11, 2007, which applications and publication are incorporated herein by reference and made a part hereof.

FIELD OF THE INVENTION

The present invention relates to a tool for use in marking tiles for cutting, in particular for use when tiling around the edges of a floor.

BACKGROUND OF THE INVENTION

When laying tiles it is typical to start by laying a region of complete tiles within the boundaries of the area to be tiled, leaving a border around the periphery of the region within which incomplete tiles are laid.

In the case of tiling a floor incomplete tiles are laid around the edges of the floor close to the wall. Tiles are typically laid with lines of grout (grout joints) both between adjacent tiles and between the wall and tiles adjacent to the wall. Consequently incomplete, peripheral tiles are commonly cut to a smaller size than the gap into which they are fitted, by an amount equal to the thickness of two lines of grout. Similarly, when laminate flooring sections are laid on a floor, the edge sections are typically cut to such a size that when fitted an "expansion gap" is left between the laid flooring and the walls.

Determining the necessary size to which the peripheral tiles require to be cut is commonly performed by means of a method referred to as the "back marking" method. In the traditional back marking method a cutting tile to be cut is overlaid on a laid tile that is adhered to the floor, the side of a ruling tile is abutted against the wall, and a line is ruled on the cutting tile, along the opposite side of the ruling tile. A second line is then ruled on the cutting that is parallel with the first line, and separated by an amount equal to the thickness of two lines of grout, such that the second line demarcates a portion of the cutting tile that will fit into the gap between the laid tile and the wall together with two lines of grout. A traditional back marking method is illustrated in FIGS. 1, 2 and 3.

In FIG. 1 tiles are being laid across a floor 100 as far as a wall 102 or skirting board. The complete laid tile 104 has been laid into position on the floor 100, such that a gap G remains between that complete tile and the wall 102. A cutting tile 106A to be cut to fit within the gap G is laid on top of the complete laid tile 104, such that the edges of the cutting tile and the adhered tile are aligned. A ruling tile 108 is laid on top the cutting tile 106A, such that the first edge 110A abuts the wall 102. A first line 112 is then ruled on the exposed surface of the cutting tile 106A by drawing a pencil 114 along the second edge 110B of the ruling tile 108.

Tiles are typically laid on a bed of adhesive 116 with gaps between the adjacent tiles and walls, before the gaps are filled with grout 118. Consequently, the cutting tile 106A typically requires to be cut to a size that is slightly smaller than the gap G, such that the cut tile 106B can be laid into the gap G with room for a line of grout 118 between the cut tile 106B and each of the complete laid tile 104 and the wall 102, as is illustrated in FIG. 2.

FIG. 3 illustrates the cutting tile 106A, on which the first line 112 has been ruled. A second line 120 is then ruled on the cutting tile 106A. The second line 120 is the line along which the cutting tile 106A will be cut, and is offset T from the first line 112 by a separation equal to the thickness of the two lines of grout 118.

To achieve the most accurate positioning of the first line 112 on the cutting tile 106A, it is necessary that the first edge 110A of the marking tile 108 should be no closer to the floor than the second edge 110B, such that the second edge is in contact with the cutting tile 106A when the first line 112 is ruled.

The required gap between the tiles for grout needs to be measured in order to determine the offset between the first 112 and second lines 120. The positions of the ends 122A and 122B of second line 120 are then marked before the second line is ruled between them.

The traditional marking method, which typically requires the use of a tape measure or ruler, is time consuming, inconvenient and may be inaccurate and messy, which lead to wasted labour and materials.

U.S. Pat. No. 6,523,272 discloses an adjustable measuring device having a base, a slidably attached slide member and a pair of opposing locking elements for releasably securing the sides of the slide member against the base. The device permits a marking end of the device to be moved relative to the base to a position that corresponds to the size of a given tile plus the grout joint spacing on each side of a perimeter tile, which is actually twice the width of the grout line.

The device of U.S. Pat. No. 6,523,272 bulky, mechanically complex to manufacture due to the number of component parts, and may be difficult use due to the number of movable parts. Further, due to its size, the device has only limited compatibility with different sizes of tile.

U.S. Pat. No. 6,481,112 discloses a tile fitting tool comprising a base and a measuring aid. The base holds a plurality of tiles, having a bottom portion for resting on a laid tile and an upturned lip for engaging an edge of a loose tile to be laid. A down-turned lip of the measuring aid may be adjustable or provided with projections or a spacing device, or a spacing device can be inserted, to account for additional spacing requirements, such a grout.

The tool of U.S. Pat. No. 6,481,112 is bulky and mechanically complex to manufacture. Further it is only suited to use with a tiles of a single width.

Thus a need remains in the industry for an alternative design of tool to facilitate the back marking of tiles, which seeks to mitigate at least some of the disadvantages of the prior art designs.

STATEMENT OF THE INVENTION

It is an object of the present invention to provide a tool for use in marking and cutting tiles that seeks to overcome at least some of the disadvantages described above.

A first aspect of the invention provides a tool suitable for holding a ruling tile for use in marking a line on a cutting tile. The tool comprises a tile receiving means and a support for the tile receiving means. The tile receiving means is adapted to space the ruling tile at a desired distance from a boundary of an area to be tiled. The ruling tile overlies the cutting tile. Optionally a laid tile is provided beneath the cutting tile.

A second aspect of the invention provides a method of marking a cutting tile. The method uses a tool suitable for holding a ruling tile for use in marking a cutting tile. The tool comprises a tile receiving means and a support for the receiving means. The ruling tile is inserted into the tile receiving means. The tile receiving means is abutted to a boundary of an area to be tiled such that the ruling tile is spaced from the boundary by a desired distance. The ruling tile arranged to overlie a cutting tile. Optionally a laid tile is provided beneath the cutting tile. A line is ruled on a surface of the cutting tile. The line is ruled adjacent to an edge of the ruling tile that is opposite to an edge received into the receiving means.

The receiving means may comprise a holding means and a base.

The holding means may be configured such that it is resiliently biased towards the base when the receiving means is in receipt of the ruling tile. The holding means may comprise a clamp, adapted to clamp a tile between the holding means and the base.

The holding means may be detachable from the receiving means. The holding means may be adjustable in size to receive different thicknesses of ruling tile. The holding means may run the length of the receiving means. Alternatively, the holding means may comprise a single arm.

The base may be provided with an abutment against which a first edge of the ruling tile may be abutted. The abutment may be a desired distance from the side of the receiving section opposed to that adapted to receive a tile.

The receiving means may be provided with a spacer on the opposite side of the receiving means from that which is adapted to receive a tile. Tiles of different types require differently sized gaps between adjacent tiles or between the cut tile and the boundary of the area to be tiled, corresponding with different thicknesses of grouting or expansion gap. A spacer may be connected to the receiving means that is of a size corresponding with the required gap or gaps adjacent to the cut tile. A tool may be chosen from a selection with differently sized spacers corresponding with differently sized thicknesses of grouting or expansion gaps. Alternatively the spacer may be adjustable in size. In yet another alternative, the spacer may be detachably connected to the receiving section, such that a spacer may be connected to the receiving means corresponding with the required gap or gaps.

The receiving means may be provided with a spine that is connected between the base and the holding means. The abutment may be a surface of the spine. The spacer may project from the spine on a side of the receiving means opposed to a side adapted to receive a tile.

The support may be detachably connected to the receiving means. Different sizes of support may be fitted corresponding with different thicknesses of tiles. The receiving means may be provided with a channel or bracket for receiving the support. In the case that the leg is a bolt, the bolt may be locked into place by means of a locking nut.

The support may comprise one leg or a plurality of legs. The leg may be individually connected to the receiving means. Alternatively the plurality of legs may be connected to a common body, which may be connected to the receiving section. The leg may comprise a steel leg. The leg may comprise a bolt. The plurality of legs may comprise two bolts.

The height of the support may be adjustable in size. The height may be adjusted to match different thicknesses of tile.

One of the receiving means, support or spacer may comprise an alignment edge. The alignment edge may be aligned with a boundary of the tiling surface.

The receiving means may comprise an extrusion. The receiving section may be formed from a thermoplastic polymer, for example polyvinyl chloride (PVC). The receiving means may be elongate. The receiving means may have a constant cross-section along a length.

The extrusion may comprise the holding means. The extrusion may comprise the support. The support may comprise a rib. The rib may be cut into a pattern of legs. The rib may be provided with feet. The extrusion may comprise the spacer.

During use, the support may be rested on the tiling surface. During use, the side of the receiving means opposite to that which is adapted to receive a tile may be held against or aligned with a boundary of the tiling surface.

Once marked with the ruled line, the cutting tile may be cut into parts along the ruled line. Once cut, a part of the cutting tile may be adhered to the tiling surface between the laid tile and a boundary of the tiling surface.

The tool and method may be used in tiling a tiling surface that is one of a floor, a wall or a ceiling. The tile may be one of ceramic tiles, expanded polystyrene tiles, cork tiles, wooden tiles, floorboards and laminate flooring sections.

BRIEF DESCRIPTION OF THE DRAWINGS

For a better understanding of the present invention and to show more clearly how it may be carried into effect, reference will now be made, by way of example only, to the accompanying drawings, in which.

DETAILED DESCRIPTION OF EMBODIMENTS

Figure 4:
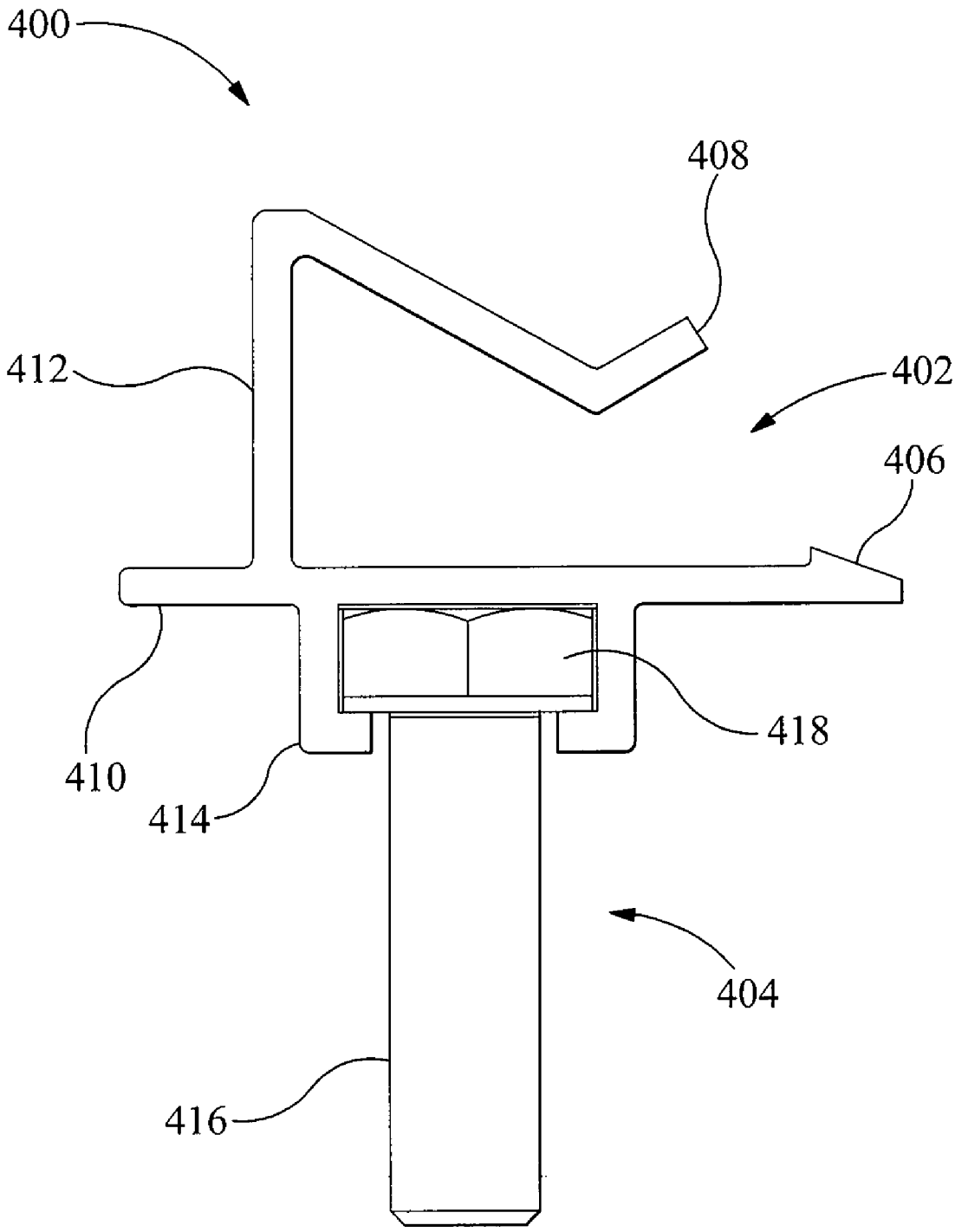
FIG. 4 is a schematic side view of a tool.

FIG. 4 illustrates side view of a tool 400 for use in marking a line on a tile. The tool 400 comprises a receiving means 402 and support 404. The support 404 is detachably connected to the receiving means 402.

The receiving means 402 comprises a base 406, holding means 408, a spacer 410, a spine 412 and a channel 414. The receiving means 402 is an extrusion, in which the spacer and the holding means form part of the extrusion.

The support 404 comprises a bolt 416. The bolt 416 is connected to the receiving means 402 by the head 418 of the bolt being received within the channel 414.

The receiving means 402 is adapted to receive a tile between the base 406 and the holding means 408. The receiving means 402 is provided with an abutment 420 against which the tile is abutted.

Figure 5:
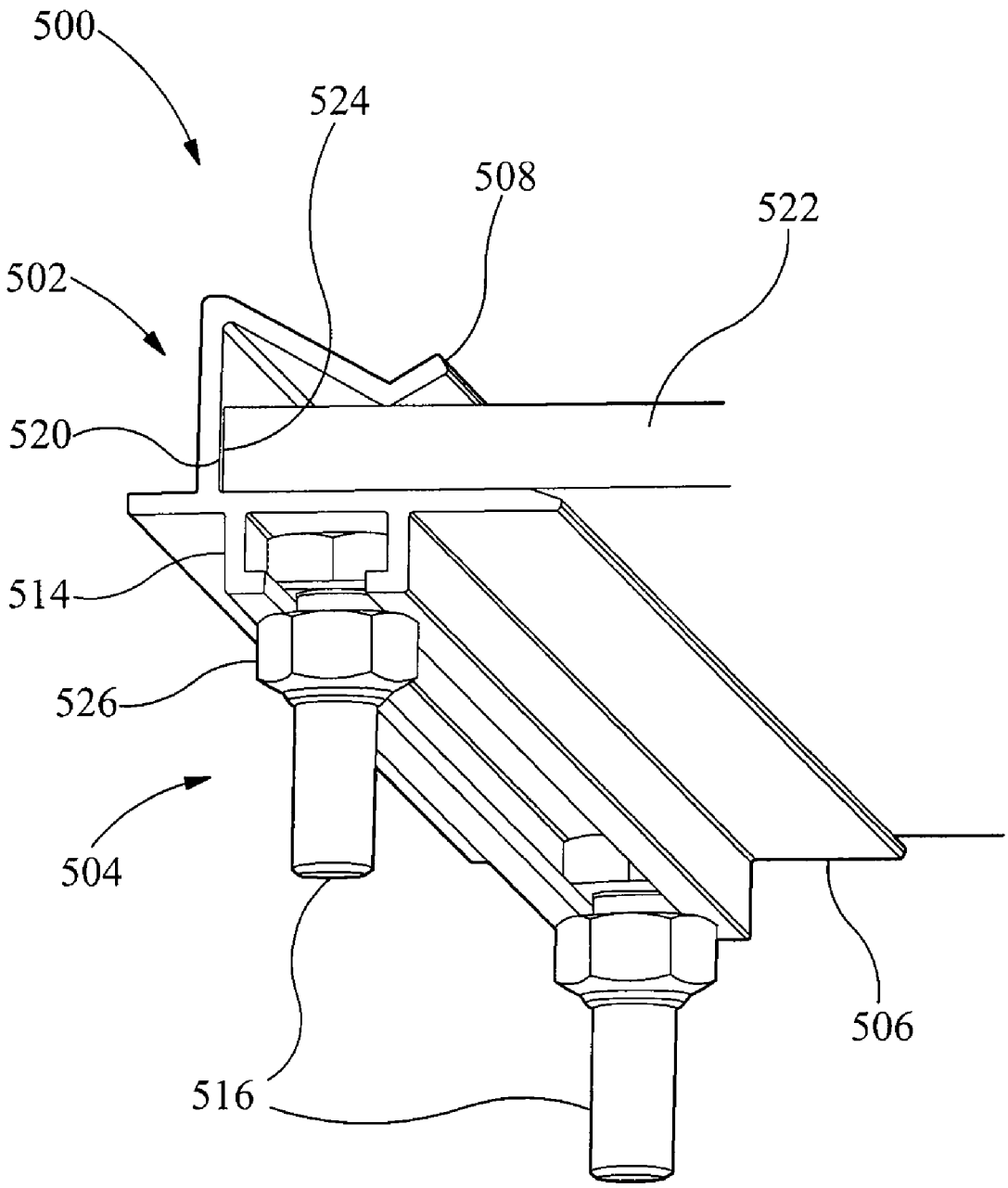
FIG. 5 is a schematic perspective view of a tool.

FIG. 5 illustrates a tool 500 for use in marking a line on a tile. The receiving means 502 of tile marking tool 500 is shown in receipt of a ruling tile 522. A first edge 524 of the ruling tile 522 is abutted to the abutment 520. The holding means 508 is resiliently deformed for the receiving means 502 to accept the inserted ruling tile 522. The holding means 508 is biased towards the base 506, such that the receiving means 502 clips onto the ruling tile 522. The holding means 508 can withstand repeated deformation without breaking or substantial reduction in bias.

The support 504 comprises a pair of bolts 516 that are received within the channel 514. The bolts 516 are provided with locking nuts 526.

Figure 6:
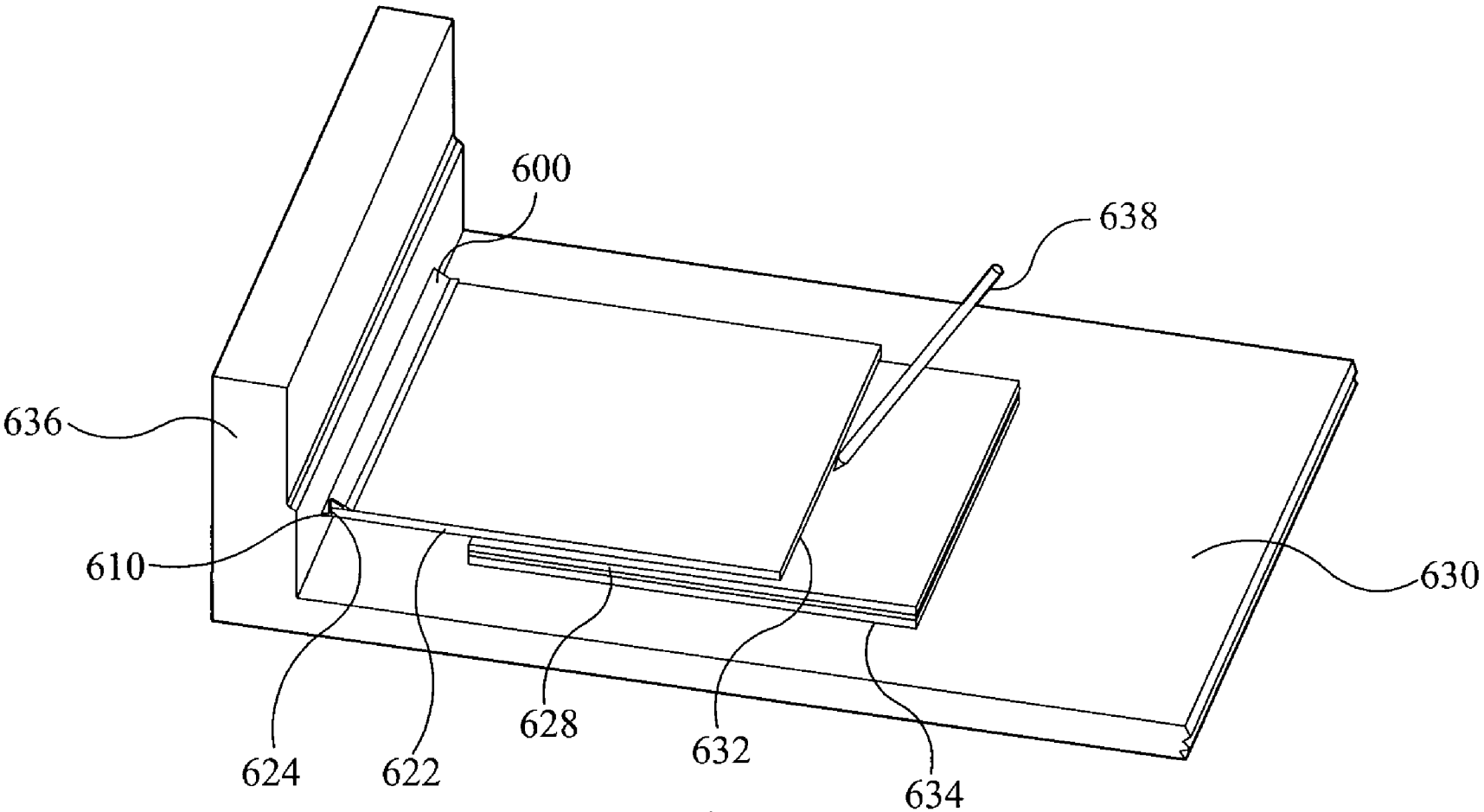
FIG. 6 is a schematic perspective view of a tool and tiles.

FIG. 6 illustrates the use of a tool 600 in marking a line on a cutting tile 628. The tool 600 is stood with the support 604 upon the tiling surface 630. The tiling surface 630 is the area to be tiled. The first edge 624 of a ruling tile 622 is received into the receiving means of the tool 600. A second edge 632 of the ruling tile 622 is overlaid on the cutting tile 628. The cutting tile 628 is overlaid on a laid tile 634, which is adhered to the tiling surface 630. Other tiles that have been laid surrounding the laid tile 634 have been omitted for clarity.

The spacer 610 of the tool 600 is held against the wall 636, which is the boundary of the tiling surface 630. A pencil 638 is used to rule a cutting line (not shown) on the cutting tile 628 along the second edge 632 of the ruling tile 622.

Figure 7A:
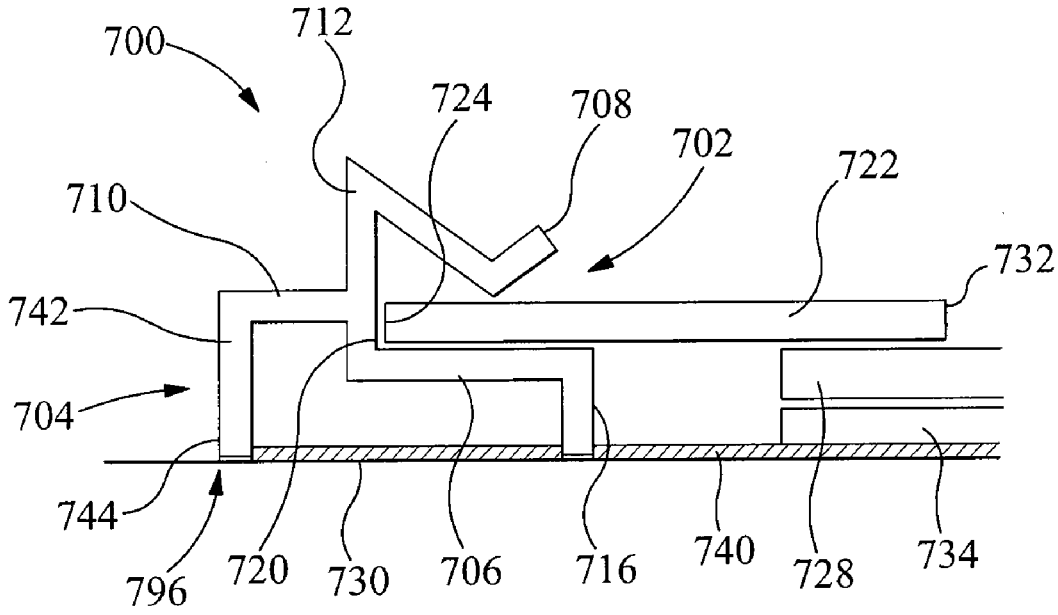
FIGS. 7A and 7B are schematic views of a further tool.

FIG. 7A illustrates a side view of a tool 700, which is extruded. The extrusion comprises a receiving means 702 and a support 704.

The receiving means 702 comprises a base 706, a spacer 710, a spine 712 and a holding means 708.

A ruling tile 722 is shown received into the receiving means 702, such that a first edge 724 abuts the abutment 720. The second edge 732 of the ruling tile 722 rests upon the cutting tile 728, which is aligned with and overlies a laid tile 734. The laid tile 734 is adhered to the tiling surface 730 by means of adhesive 740.

The support 704 comprises a first ridge 716 and a second ridge 742. The second ridge 742 has an alignment edge 744. When tiling adjacent to a wall, the alignment second ridge can be abutted against the wall.

FIG. 7A illustrates use of the tool 700 in a case where the boundary 746 of the tiling surface 730 does not terminate against a wall or other surface that is perpendicular to the tiling surface 730. In such a case the alignment edge 744 can be aligned with the boundary 746 so that a cutting line can be ruled along the cutting tile 728.

Figure 7B:
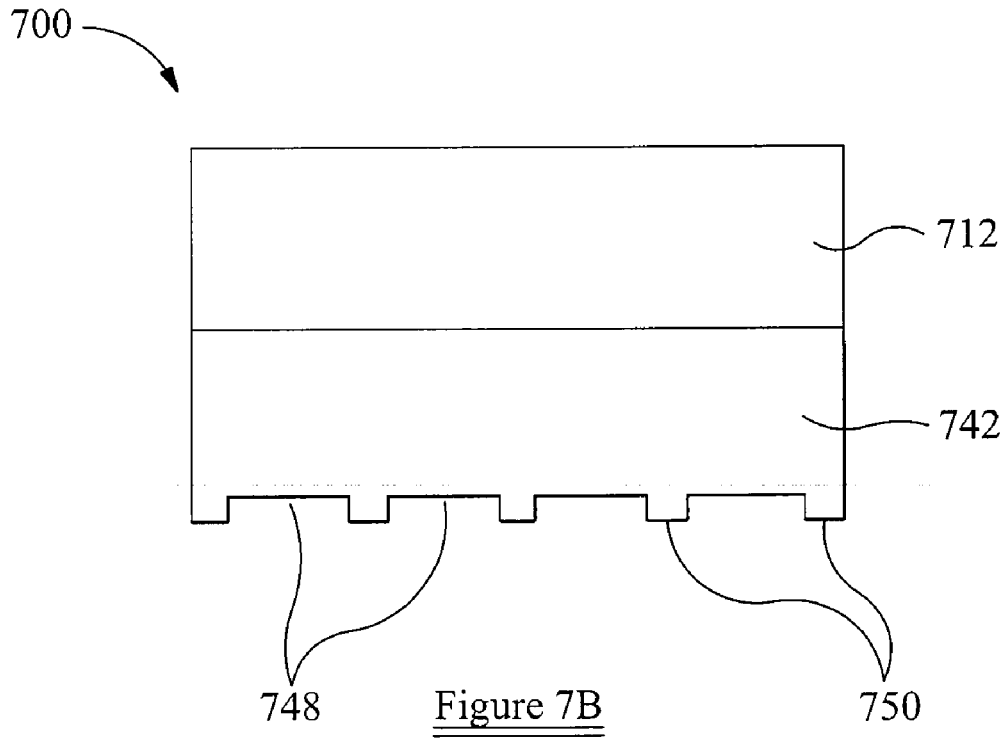

FIG. 7B illustrates a rear view of the tool 700 of FIG. 7A, such that the spine 712 and second ridge 742 are visible. The second ridge 742 is provided with cut-outs 748 to form feet 750. The feet 750 serve to support the main part of the tool 700 above any layer of adhesive 740 that may cover the tiling surface 730.

Figure 1:
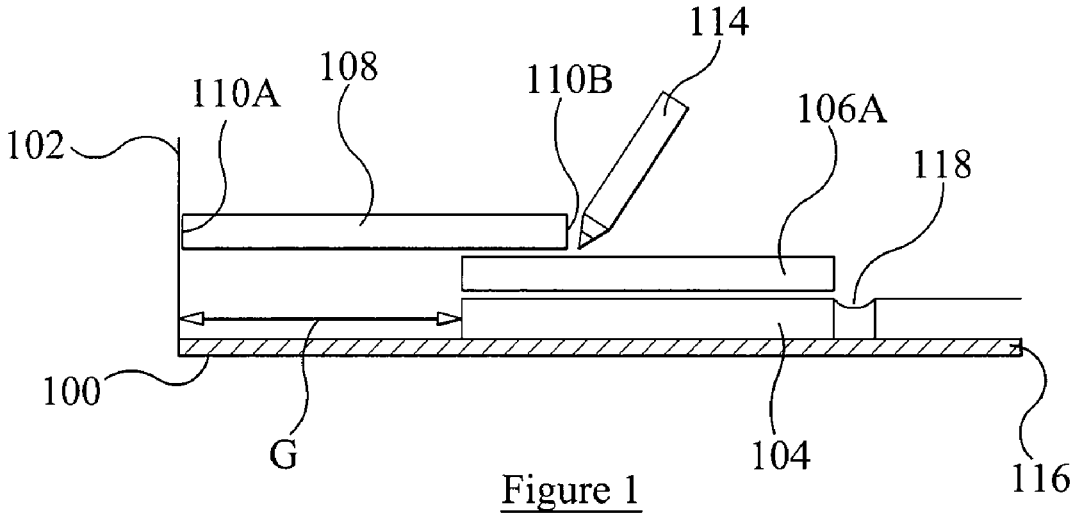
Figure 1 PRIOR ART
FIG. 1 is a schematic side view of a tiling arrangement in which a line is ruled on a cutting tile according to the traditional back marking method.
Figure 2:
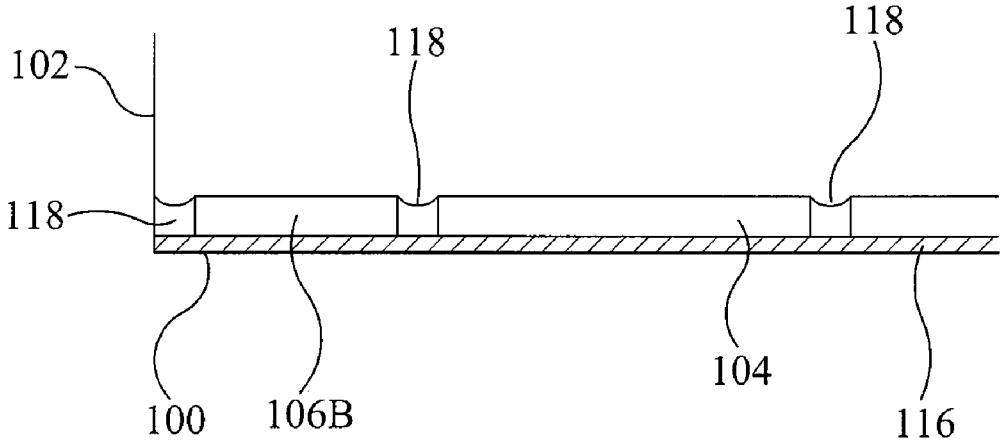
Figure 2 PRIOR ART
FIG. 2 is a schematic side view of a tiling arrangement after a cut tile has been laid.
Figure 3:
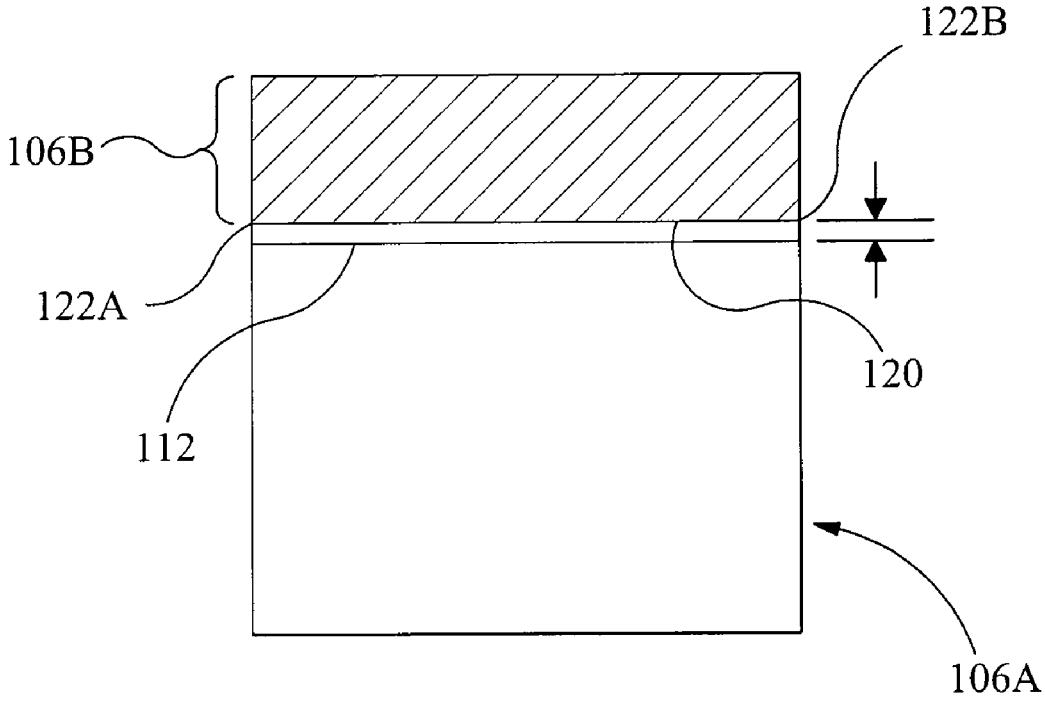
Figure 3 PRIOR ART
FIG. 3 is a plan view of a cutting tile according to the traditional back marking method.
Figure 8:
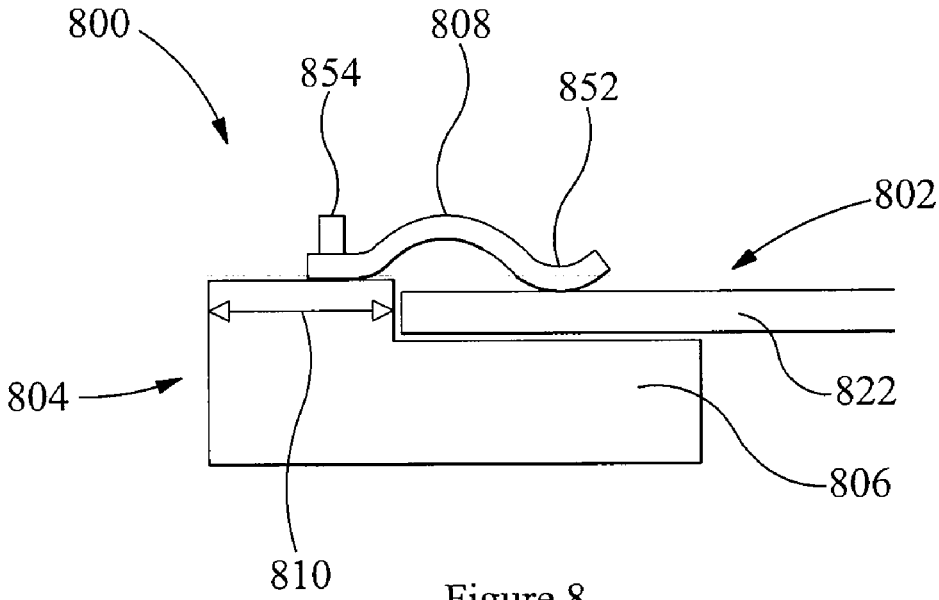
FIG. 8 is a schematic side view of yet another tool.

FIG. 8 illustrates a tool 800, comprising a receiving means into which a ruling tile 822 is received, and a support 804. The receiving means comprises a base 806 and a holding means 808. The holding means 808 comprises a resiliently deformable sprung arm 852 that is connected to the base 806 by means of a fixture 854.

Use in laying laminate flooring falls within the scope of the present invention. The tool according may be used in marking a cutting line along a laminate flooring section, such that the cut section can be fitted adjacent to the region of complete sections leaving an expansion gap between the cut section and the wall.

Many laminate flooring sections typically strip-shaped, and have long sides with narrower ends. When marking cutting lines along the length of a cutting section the ruling section may advantageously be held by two or more tools in cooperation. For example a pair of tools can be fitted, spaced apart, to one side of a ruling section.

Further, although described the invention has been described with respect to tiling floors, the tool is also suitable for use in tiling other surfaces, including by not limited to walls and ceilings.

The invention claimed is:

1. A tool suitable for holding a ruling tile for using in marking a cutting line on a cutting tile, the tool, comprising:

a tile receiving portion adapted to receive a first edge of the ruling tile and to space the ruling tile at a desired distance from a boundary of an area to be tiled, wherein the tile receiving portion comprises a holding portion and a base, and the tile receiving portion is adapted to receive the first edge of the ruling tile between the holding portion and the base, wherein the holding portion is configured such that it is resiliently biased towards the base when the tile receiving portion is in receipt of the ruling tile, and a support for the tile receiving portion, whereby the ruling tile can overlie the cutting tile and optionally a laid tile beneath the cutting tile.

2. The tool according to claim 1, wherein the base is connected to the holding portion by a spine, and the spine comprises an abutment adapted for abutment by the first edge of the ruling tile.

3. The tool according to claim 1, wherein the base has an abutment for a first edge of the received ruling tile.

4. The tool according to claim 1, wherein the holding portion is adjustable in size.

5. The tool according to claim 1, wherein the holding portion is detachably connected to the receiving portion.

6. The tool according to claim 1, wherein the holding portion is an extruded holding portion.

7. The tool according to claim 1, wherein the tile receiving portion has a spacer on the opposite side of said tile receiving portion from that which is adapted to receive the ruling tile.

8. The tool according to claim 7, wherein the spacer is an extruded spacer.

9. The tool according to claim 7, wherein the spacer is adjustable in size.

10. The tool according claim 7, wherein the spacer is detachably connected to the tile receiving portion.

11. The tool according to claim 1, wherein the support is an extruded support.

12. The tool according to claim 1, wherein the support is adjustable in size.

13. The tool according claim 1, wherein the support is detachably connected to the tile receiving portion.

14. The tool according to claim 1, wherein the support comprises one or more legs.

15. The tool according to claim 1, wherein the support comprises a bolt.

16. The tool according to claim 1, wherein the tile receiving portion has a channel or bracket for receiving the support.

17. A method of marking a cutting tile using a tool suitable for holding a ruling tile for use in marking a cutting tile, comprising:

the tool comprising a tile receiving portion, and a support for the tile receiving portion; and the method comprising inserting a first edge of a ruling tile into the tile receiving portion;

abutting the tile receiving portion to a boundary of an area to be tiled such that the ruling tile is spaced from the boundary by a desired distance;

arranging the ruling tile to overlie a cutting tile and optionally a laid tile beneath the cutting tile; and ruling a cutting line on a surface of the cutting tile, the cutting line being adjacent to a second edge of the ruling tile that is opposite to the first edge inserted into the tile receiving portion.

18. The method according to claim 17, further comprising: cutting the cutting tile into parts along the cutting line.

19. A tool suitable for holding a ruling tile for using in marking a cutting line on a cutting tile, the tool, comprising:

a tile receiving portion adapted to receive a first edge of the ruling tile and to space the ruling tile at a desired distance from a boundary of an area to be tiled, wherein the tile receiving portion comprises a holding portion and a base, and the tile receiving portion is adapted to receive the first edge of the ruling tile between the holding portion and the base, wherein the holding portion comprises a clamp that is adapted to clamp the ruling tile between the holding portion and the base, and a support for the tile receiving portion, whereby the ruling tile can overlie the cutting tile and optionally a laid tile beneath the cutting tile.

* * * * *